US009618211B2

(12) United States Patent
Stone

(10) Patent No.: US 9,618,211 B2
(45) Date of Patent: Apr. 11, 2017

(54) COMMERCIAL COOKING OVEN WITH REMOVABLE DOOR ASSEMBLY

(71) Applicant: Nicholas C. Stone, Bel Air, MD (US)

(72) Inventor: Nicholas C. Stone, Bel Air, MD (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 392 days.

(21) Appl. No.: 14/165,080

(22) Filed: Jan. 27, 2014

(65) Prior Publication Data

US 2015/0211745 A1 Jul. 30, 2015

(51) Int. Cl.

| | |
|---|---|
| ***F23M 7/00*** | (2006.01) |
| ***F24C 15/04*** | (2006.01) |
| ***E05D 7/10*** | (2006.01) |
| ***F24C 15/02*** | (2006.01) |

(52) U.S. Cl.

CPC ..... *F24C 15/045* (2013.01); *E05D 7/10* (2013.01); *F24C 15/023* (2013.01); *E05Y 2900/308* (2013.01)

(58) Field of Classification Search

CPC ..... F24C 15/028; F24C 15/02; F24C 15/023; F24C 15/006; F24C 15/04; F24C 15/045; E05Y 2900/132; H05B 6/763; A21B 3/02

USPC ..... 126/198, 193, 21 R

See application file for complete search history.

(56) References Cited

U.S. PATENT DOCUMENTS

| | | | | | |
|---|---|---|---|---|---|
| 1,315,039 | A * | 9/1919 | Roy | F24C 15/02 | 126/190 |
| 1,394,683 | A | 10/1921 | McWilliams | | |
| 1,969,197 | A * | 8/1934 | Barker | F24C 15/02 | 126/190 |
| 2,748,420 | A * | 6/1956 | Wilkendorf | E05D 7/02 | 16/265 |

(Continued)

FOREIGN PATENT DOCUMENTS

| | | |
|---|---|---|
| GB | 427992 | 5/1935 |
| GB | 451702 | 8/1936 |
| JP | 2000014567 | 1/2000 |

OTHER PUBLICATIONS

PCT, International Search Report and Written Opinion of the International Search Authority, International Application No. PCT/US2015/012832; date of mailing Apr. 16, 2015, 11 pages.

(Continued)

*Primary Examiner* — Kenneth Rinehart
*Assistant Examiner* — Jason Lau
(74) *Attorney, Agent, or Firm* — Thompson Hine LLP

(57) ABSTRACT

A cooking oven includes a housing defining an internal cooking cavity with an opening. A door assembly includes an inner panel framing an inner glass pane, and an outer panel framing an outer glass pane. A pivot arrangement pivotably mounts the door assembly to the housing. The pivot arrangement includes at least one pivot part located on the door assembly and at least one pivot part located on the housing. The pivot part of the door assembly is separable from the pivot part of the housing via vertically upward (Continued)

movement of the door assembly and upon separation of the pivot part of the door assembly from the pivot part of the housing the door becomes completely removed from the housing to enable the door assembly to be taken to a washing station for cleaning.

13 Claims, 4 Drawing Sheets

(56) References Cited

U.S. PATENT DOCUMENTS 3,267,930 A * 8/1966 Casciani ..... F24C 15/04 126/200
3,453,997 A * 7/1969 Klepzig ..... F24C 15/02 126/198
3,965,325 A 6/1976 Hirai
4,188,867 A 2/1980 DeRemer
4,244,285 A 1/1981 Baker
4,307,285 A 12/1981 DeRemer
4,368,721 A 1/1983 Kroupa
4,453,457 A 6/1984 Gongwer et al.
4,479,737 A * 10/1984 Bergh ..... B65D 55/02 220/690
4,493,976 A 1/1985 Wilson
4,556,772 A 12/1985 McCammon et al.
4,606,324 A * 8/1986 Katona ..... F24C 15/04 126/198
4,865,864 A 9/1989 Rijswijck
5,038,541 A * 8/1991 Gibbar, Jr. ..... E04B 2/8652 52/295
5,107,097 A 4/1992 Negandhi et al.
5,144,879 A 9/1992 Alessi
5,630,438 A * 5/1997 Hoover ..... A47L 15/0081 134/201
5,676,044 A 10/1997 Lara, Jr.
5,679,173 A * 10/1997 Hartman ..... A47L 15/4236 134/18
5,732,614 A * 3/1998 Oslin ..... A21B 1/26 126/20
5,780,815 A 7/1998 Mestnik et al.
5,928,540 A 7/1999 Antoine et al.
5,994,672 A 11/1999 Mestnik
6,060,700 A 5/2000 Perlman et al.
6,151,757 A * 11/2000 Beals, Jr. ..... E05D 5/12 16/262
6,271,502 B1 * 8/2001 Lee ..... F24C 15/02 126/194
6,453,802 B1 * 9/2002 Manganiello ..... A21B 3/04 126/20
6,561,180 B1 * 5/2003 Austin ..... F24C 15/04 126/190
6,608,288 B2 8/2003 Maahs
6,812,442 B2 11/2004 Kim et al.
6,945,159 B2 9/2005 Lee
7,282,674 B2 10/2007 Hansen et al.
7,368,683 B2 * 5/2008 Kim ..... F24C 15/006 126/20
7,849,650 B2 * 12/2010 Tonyan ..... B32B 3/06 106/735
8,124,920 B1 2/2012 Weber
8,523,300 B2 * 9/2013 Najera Bernal ..... D06F 39/14 312/228
2005/0224068 A1 * 10/2005 Kim ..... F24C 15/006 126/198
2006/0196495 A1 * 9/2006 Kim ..... F24C 15/006 126/198
2009/0100796 A1 * 4/2009 Denn ..... E04B 1/18 52/849
2009/0110592 A1 * 4/2009 Lee ..... F24C 15/2014 422/5
2009/0193734 A1 * 8/2009 Harig ..... B67D 7/0272 52/270
2009/0194090 A1 * 8/2009 Kim ..... F24C 15/04 126/198
2010/0139638 A1 * 6/2010 Hargrave ..... F24C 15/008 126/19 R
2013/0032132 A1 * 2/2013 Yantis ..... F24C 15/02 126/192

OTHER PUBLICATIONS

*KA Series Self-Cleaning Electric Rotary Oven*, Nov. 2012, Hobart, Troy, Ohio, pp. 1-4.
Prior Art Statement—Admitted Prior Art.

* cited by examiner

COMMERCIAL COOKING OVEN WITH REMOVABLE DOOR ASSEMBLY

TECHNICAL FIELD

This application relates generally to commercial cooking ovens and, more specifically, to an oven including a door assembly that is removable to facilitate cleaning.

BACKGROUND

In commercial kitchens (e.g., found in restaurant, cafeteria and retail environments) ovens of various types are used for cooking a large variety of food items. Oven doors commonly include glass panes that allow users to see into the cooking cavity.

In one example, the oven door may be made up of two distinct door segments, each with its own glass pane, where the two segments are each pivotally mounted to the oven housing. The two door segments pivot together during normal opening and closing for oven cavity access, but may also be independently pivoted relative to each other to access the space between the door segments for cleaning of the space between the door segments (e.g., cleaning of the glass pane surfaces that face each other). In this example, it is known to make the inner door segment removable from its pivot via a simple lifting operation, while the outer door segment is not removable from its pivot by such an operation. This arrangement facilitates oven assembly in embodiments that utilize the two distinct door segments.

In another example, the oven door is single unit having an inner skin, an outer skin and a pair of spaced apart glass panes mounted to a common frame that is mounted between the skins. By mounting the glass panes in a gasketed manner to the common frame, the interior surfaces of the glass panes are substantially isolated from potential exposure to cooking residues and other contaminants, thus avoiding any need for regular cleaning of those interior surfaces.

Cleanability of equipment in the commercial cooking environment is an important factor. It would be desirable to provide an oven having a removable door assembly that is also configured to facilitate cleaning.

SUMMARY

In one aspect, a cooking oven includes a housing defining an internal cooking cavity with an opening for enabling food items to be moved into and out of the cooking cavity. A door assembly includes an inner panel framing an inner glass pane, and an outer panel framing an outer glass pane that is spaced apart from the inner glass pane. A pivot arrangement pivotably mounts the door assembly to the housing for permitting movement of the door assembly about a vertical pivot axis between a closed position and an open position relative to the cooking cavity. The pivot arrangement includes at least one pivot part located on the door assembly and at least one pivot part located on the housing. The pivot part of the door assembly is separable from the pivot part of the housing via vertically upward movement of the door assembly and upon separation of the pivot part of the door assembly from the pivot part of the housing the door becomes completely removed from the housing to enable the door assembly to be taken to a washing station for cleaning. The door assembly includes a plurality of openings that permit fluid to enter a space between both the inner panel and the outer panel and the inner glass pane and the outer glass pane.

In one implementation, the door assembly includes an inner skin an outer skin. The inner skin includes the inner panel and at least one flange having multiple openings therein. The outer skin includes the outer panel and at least one flange having multiple openings therein. The inner skin is assembled with the outer skin such that the flange of the inner skin overlaps with the flange of the outer skin, with the openings of the respective flanges aligned to provide fluid access to the space between both the inner panel and the outer panel and the inner glass pane and the outer glass pane.

In one implementation, the door assembly further includes a frame component extending along top, bottom and side portions of the door assembly. The frame component includes a frame segment with a plurality of openings therein that align with the aligned openings of the respective flanges of the inner skin and the outer skin.

In one implementation, the inner skin, outer skin and frame component are secured together by multiple fasteners.

In one implementation, the pivot part of the door assembly is a female member and the pivot part of the housing is a male member.

In one implementation, the door assembly includes an inner skin an outer skin and a frame component. The inner skin includes the inner panel and top, bottom, left and right flanges. The outer skin includes the outer panel and top, bottom, left and right flanges. The frame component includes an upper frame segment, a lower frame segment a first side frame segment and a second side frame segment. The inner skin, outer skin and frame component are assembled together such that: the upper, lower, left side and right side frame segments of the frame component are located inward of the upper, lower, left and right flanges of the inner skin; and the upper, lower, left and right flanges of the inner skin are located inward of the upper, lower, left and right side flanges of the outer skin.

In another aspect, a cooking oven includes a housing defining an internal cooking cavity with an opening for enabling food items to be moved into and out of the cooking cavity. A door assembly includes an inner skin with a first opening covered by an inner glass pane, an outer skin with a second opening covered by an outer glass pane, the inner skin and the outer skin connected together to hold the inner glass pane and outer glass pane in an aligned but spaced apart relationship. A pivot arrangement pivotably mounts the door assembly to the housing for permitting movement of the door assembly about a vertical pivot axis between a closed position and an open position relative to the cooking cavity, the pivot arrangement including at least one pivot part fixed to the door assembly and at least one pivot part fixed to the housing. The pivot part of the door assembly is separable from the pivot part of the housing via vertically upward movement of the door assembly and upon separation of the pivot part of the door assembly from the pivot part of the housing the door becomes removed from the housing to enable the door assembly to be taken to a washing station for cleaning. The door assembly also includes a plurality of openings that permit fluid to enter a space between both the inner skin and outer skin and the inner glass pane and the outer glass pane.

In one implementation, the inner skin includes an inner panel and at least an upper flange and a lower flange, the inner panel framing the first opening, and each of the upper flange and the lower flange including multiple openings therein. The outer skin includes an outer panel and at least an upper flange and a lower flange, the outer panel framing the second opening, and each of the upper flange and the lower flange including multiple openings therein. The inner skin is assembled with the outer skin such that the upper flange of the inner skin overlaps with the upper flange of the outer skin with the openings of each upper flange aligned, and the lower flange of the inner skin overlaps with the lower flange of the outer skin with the openings of each lower flange aligned.

In one implementation, the door assembly further includes a frame component extending along top, bottom and side portions of the door assembly, the frame component including an upper frame segment with a plurality of openings therein that align with the aligned openings of the upper flanges, the frame component including a lower frame segment with a plurality of openings therein that align with the aligned openings of the lower flanges.

In one implementation, the inner skin, outer skin and frame component are secured together by multiple fasteners.

In one implementation, the inner skin includes first and second side flanges, the outer skin includes first and second side flanges and the frame component includes first and second side frame segments. The first flange of the inner skin, first flange of the outer skin and first side frame segment are positioned in a stacked manner, and the second flange of the inner skin, second flange of the outer skin and second side frame segment are positioned in a stacked manner.

In one implementation, the inner skin includes first and second side flanges, and the outer skin includes first and second side flanges. The door assembly further includes a frame component extending about top, bottom and side portions of the door assembly, the frame component including an upper frame segment, a lower frame segment a first side frame segment and a second side frame segment. The upper, lower, left side and right side frame segments of the frame component are located respectively inward of and adjacent to the upper, lower, left and right flanges of the inner skin. The upper, lower, left and right flanges of the inner skin are located respectively inward of and adjacent to the upper, lower, left and right side flanges of the outer skin.

In one implementation, the upper fame segment includes a plurality of openings therein that align with the aligned openings of the upper flanges, the lower fame segment includes a plurality of openings therein that align with the aligned openings of the lower flanges.

In one implementation, the inner skin, outer skin and frame component are secured together by multiple fasteners.

In one implementation, the pivot part of the door assembly is a female member and the pivot part of the housing is a male member.

The details of one or more embodiments are set forth in the accompanying drawings and the description below. Other features, objects, and advantages will be apparent from the description and drawings, and from the claims.

DETAILED DESCRIPTION

Figure 1:
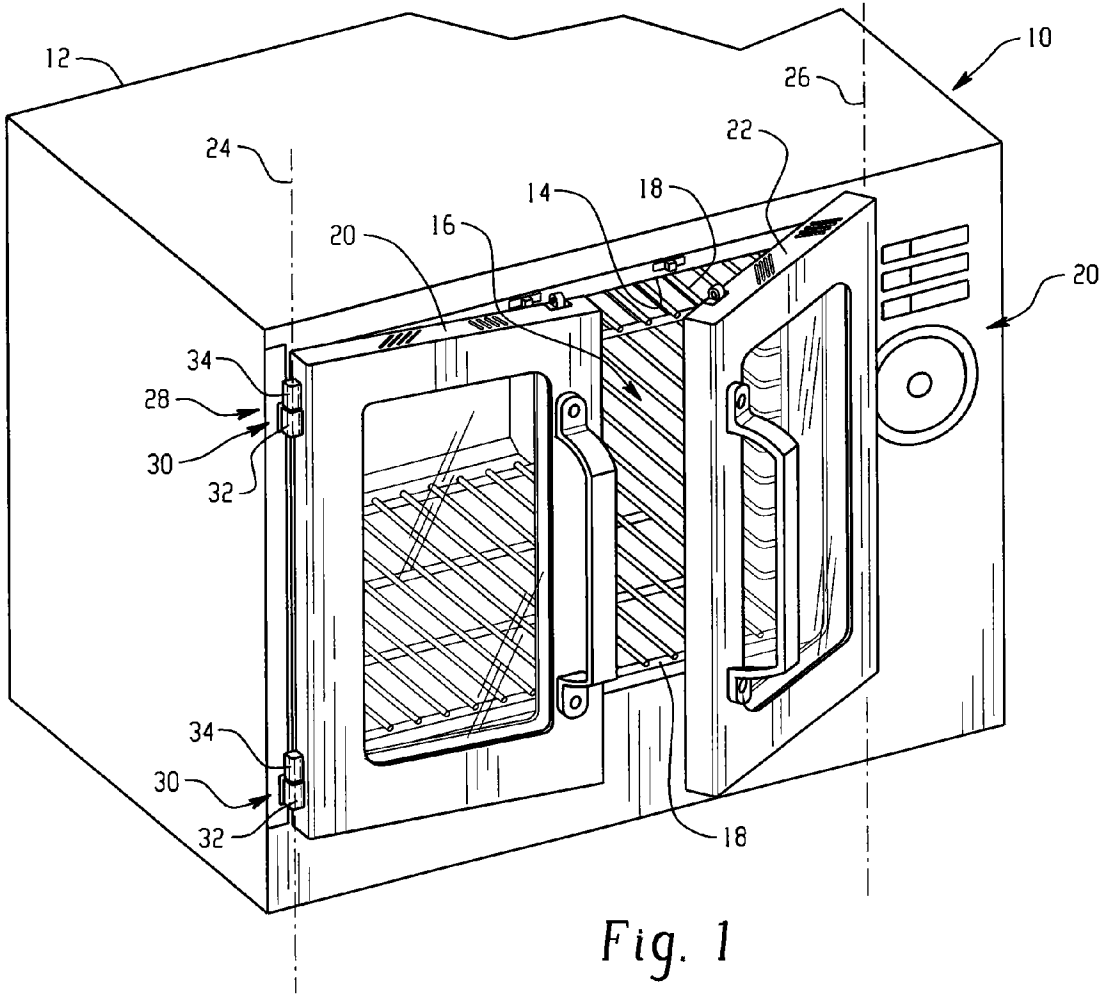
FIG. 1 a perspective view of one embodiment of a cooking oven.
Figure 3:
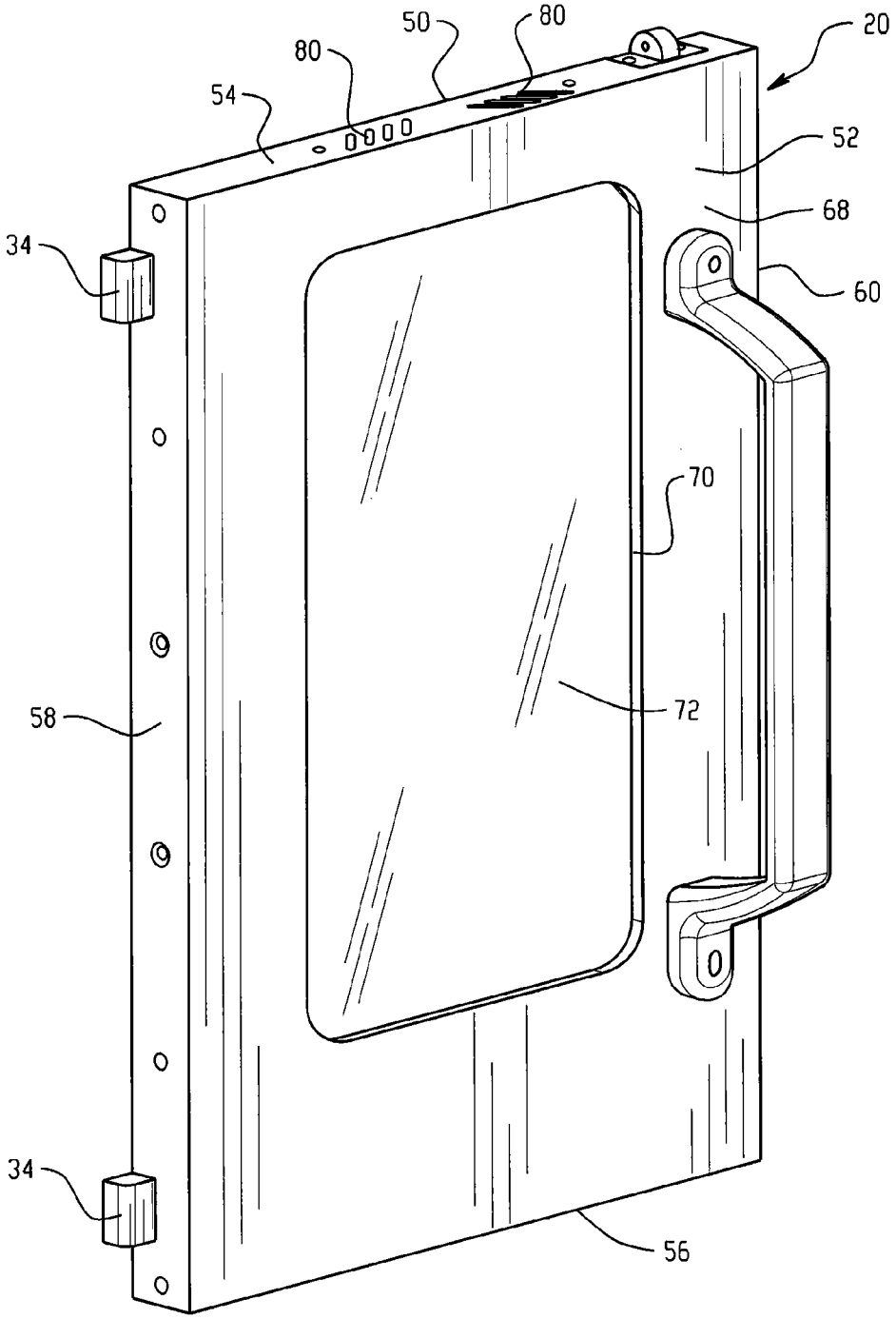
FIG. 3 is a perspective view of one door assembly of FIG. 1.

Referring to FIG. 1, one embodiment of a cooking oven 10 is shown. The oven includes a housing 12 with top, bottom, front, rear and left and right sides. The front side of the housing includes an opening 14 through which food items can be moved into and out of an internal cooking cavity 16. The housing 10 may, by way of example, be made up of external skins (e.g., of stainless steel), frame components and internal cavity walls (e.g., also of stainless steel), with insulation therebetween to help hold heat within the cavity 16. In this regard, the cooking cavity may have an associated heating arrangement of any suitable type. By way of example, the cooking cavity 16 may include one or more of (i) internal resistive heating elements, (ii) a convection heating system with resistive or gas heating elements located external of the cavity 16 (e.g., in a heating chamber behind the rear internal cavity wall) and one or more blowers to circulate air between the cavity 16 and the heating chamber, (iii) a steam heating arrangement to create steam within, or deliver steam into, the cavity 16 or (iv) microwave or other RF energy sources. The cooking cavity may also include an internal rack system with one or more food product receiving racks 18. User interface controls 20 are also shown alongside the cavity.

The illustrated oven 10 includes two door assemblies 20, 22, each of which is mounted to the housing 12 for rotation about a respective vertical pivot axis 24, 26. The pivoting action enables each of the doors to move independently between a closed position and an open position relative to the cooking cavity. As described in further detail below, each of the doors 20, 22 is easily removable from the housing to facilitate cleaning. Moreover, the door assemblies themselves include features that facilitate the cleaning operation once removed. Although the illustrated oven embodiment includes two doors, ovens with only a single door are contemplated and considered within the scope of this application as well.

As seen with respect to door 20, the door assembly includes a pivot arrangement 28 that enables the pivot. In particular, the pivot arrangement includes two pivot assemblies 30, each of which is formed by a pivot part 32 mounted to the housing 12, and a pivot part 34 mounted to the door 20. Although not seen in the view of FIG. 1, door 22 includes a similar pivot arrangement.

Figure 2:
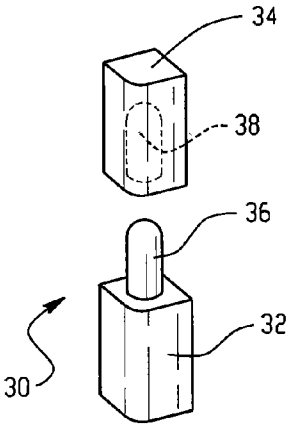
FIG. 2 is a partial perspective view of a portion of a pivot assembly of the oven of FIG. 1.

As reflected in FIG. 2, in one embodiment the pivot part 32 includes an upwardly extending pin 36 so as to operate as a male member of the pivot assembly, and the pivot part 34 includes a lower opening and upwardly extending recess 38 so as to operate as a female member of the pivot assembly. Incorporating the female member of the pivot onto the door is generally preferred for the purpose of cleanability, as the recess is generally more difficult to clean than the pin. However, it is recognized that in certain embodiments it may be acceptable to incorporate the female member of the pivot on the oven housing and the male member of the pivot on the door. The pin 36 fits within the recess 38 in a manner to provide stability to the pivot while at the same readily enabling separation of pivot part 34 from pivot part 32 by vertically upward movement of the door. Thus, the doors can be readily removed from the oven, taken to a washing station, sprayed and/or submerged at the washing station as needed for cleaning and then returned to the oven and remounted, all without requiring the use of any tools. In the illustrated embodiment the recess 38 terminates within the pivot part 34, but in an alternative arrangement the recess 38 could be a through opening extending completely from top to bottom of the pivot part.

Figure 5:
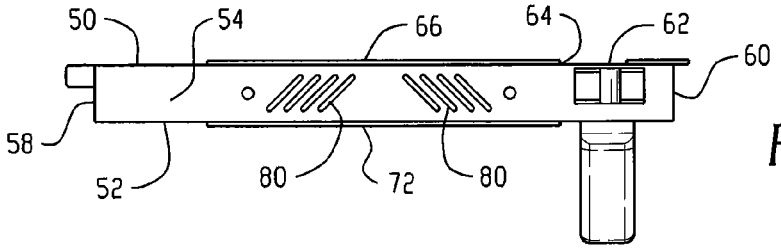
FIG. 5 is a top view of the door assembly of FIG. 3.
Figure 4:
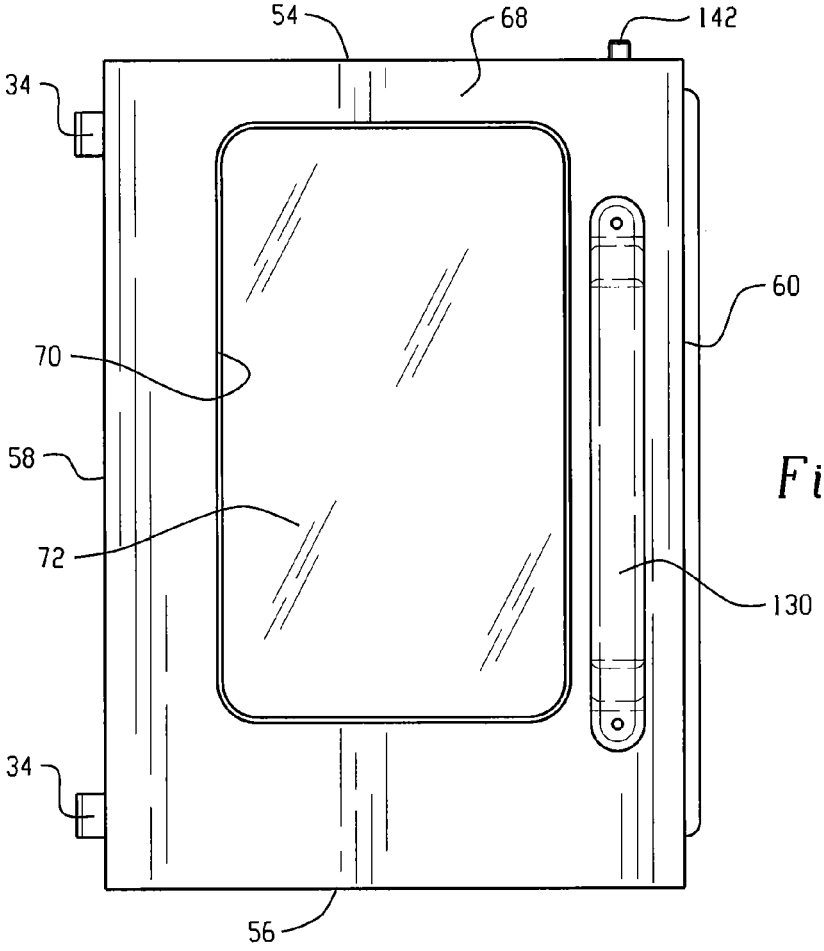
FIG. 4 is a front elevation view of the door assembly of FIG. 3.
Figure 6:
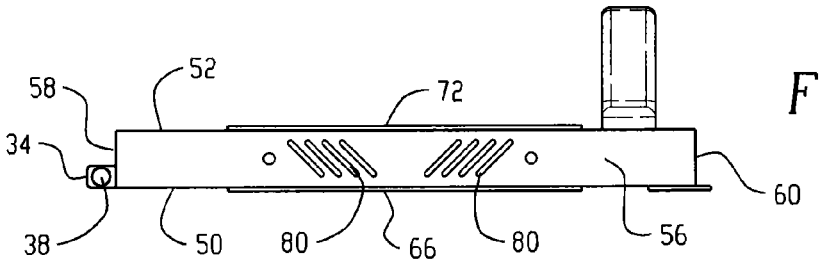
FIG. 6 is a bottom view of the door assembly of FIG. 3.
Figure 7:
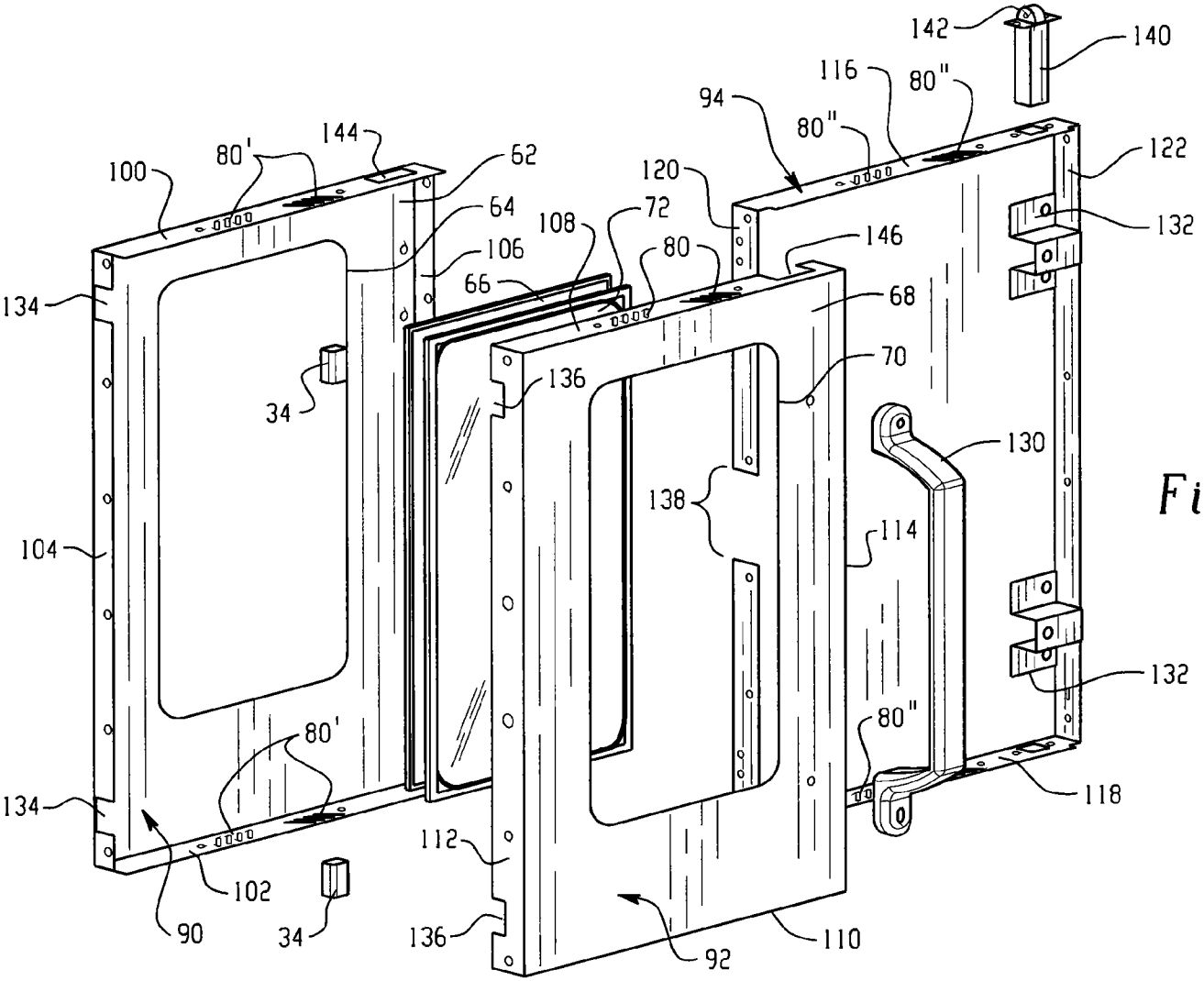
FIG. 7 is an exploded partial perspective view of the door assembly of FIG. 3.

Referring now to FIGS. 3-7, one embodiment of door assembly 20 is shown, it being understood that door assembly 22 may be of a similar, but mirror-image configuration. The door assembly includes an inner side 50, outer side 52, top edge 54, bottom edge 56 and side edges 58 and 60. The inner side 50 includes an inner panel 62 framing an opening 64 and inner glass pane 66 held therein. The outer side 52 includes an outer panel 68 framing an opening 70 and outer glass pane 72 held therein. The glass panes 66 and 72 are held in spaced apart relationship to each other. Notably, the door assembly includes a plurality of openings 80 that permit fluid to enter a space between both the inner panel and the outer panel and the inner glass pane and the outer glass pane. The illustrated openings 80 take the form of sets of elongated slots, but it is recognized that other opening configurations could be used. As best seen in FIGS. 5 and 6, openings 80 may be located in opposed edges of the door assembly (e.g., in this case the top and bottom edges) to readily allow fluid to pass through the door assembly. This opening arrangement allows cleaning fluid (e.g., water and cleaner solution) to enter the internal space of the door assembly and likewise allows rinsing fluid (e.g., water only or water and rinse aid) to enter and flush the internal space of any suds. In some embodiments, one or more surfaces within the internal space of the door include a film or covering that enhances the rinse away of any cleaning compounds. Notably, the opening arrangement also permits air to pass upward through the internal spaced of the door assembly during cooking operations, helping to keep the outer side of the door cool.

The body of the door assembly 20 is of multi-piece construction, including an inner skin 90, outer skin 92 and frame component 94, as well as glass pane units. Each glass pane 66 and 72 may include a respective metal frame that is utilized to attach the glass pane to a respective one of the skins 90 and 92. Thus, the glass panes are independent of each other and fluid within the door assembly can flow freely between the panes. The inner skin 90 includes the inner panel 62, top flange 100, bottom flange 102 and side flanges 104 and 106. The outer skin 92 includes the outer panel 68, top flange 108, bottom flange 110 side flanges 112 and 114. Both of the skins may, for example, be formed from stainless steel sheet that is cut to form the various openings and bent to create the flanges. The frame component 94 includes an upper frame segment 116, a lower frame segment 118 and side frame segments 120 and 122. The frame component may similarly be formed from stainless steel sheet that is cut and bend, though the frame component may be of a thicker gauge than the skins so that the frame component provides structural rigidity for the door assembly.

The upper flanges 108 and 100 and upper frame segment 116 include like openings 80, 80' and 80" that are positioned to align with each other upon assembly of the components in order to enable the fluid passage into and out of the internal space of the door. The lower flanges 110, 102 and lower frame segment 118 are similarly configured with openings that will align upon assembly. As seen, the various flanges and frame segments also include circular openings that are intended to align so that fasteners can be used to secure the door components together (e.g., with the fasteners engaging threaded openings on the frame component 94). In this regard, in the illustrated embodiment the inner skin 90, outer skin 92 and frame component 94 are assembled together such that the upper 116, lower 118 and side 120 and 122 frame segments of the frame component 94 are located inward of and adjacent to the upper 100, lower 102 and side 104 and 106 flanges of the inner skin 90, and the upper 100, lower 102 and side 104 and 106 flanges of the inner skin 90 are located inward of and adjacent to the upper 108, lower 110 and side 112 and 114 flanges of the outer skin 92. Thus, the various adjacent flanges and frame segments are positioned adjacent each other in a stacked manner and held together with fasteners.

The door assembly 20 includes a handle 120 secured at the outer side of the door by way of fasteners that interact with brackets 132 located internally of the door and secured to the inner panel 62. The side flanges 104 and 112 of the skins include respective cutouts 134 and 136 that align with each other and provide access for the pivot parts to be secured directly to the frame segment 120, which in the illustrated embodiment is formed with a discontinuity 138. A latching mechanism 140 is attached to frame segment 116 and includes a latching member 142 (e.g., an upwardly biased roller) that protrudes from the top of the assembled door to permit interaction with a portion of the housing to hold the door in the closed condition. Flanges 100 and 108 include respective openings or cutouts 144 and 146 to facilitate the latching member.

It is to be clearly understood that the above description is intended by way of illustration and example only, is not intended to be taken by way of limitation, and that other changes and modifications are possible.

What is claimed is:

1. A cooking oven, comprising:

a housing defining an internal cooking cavity with an opening for enabling food items to be moved into and out of the cooking cavity;

a door assembly including an inner panel framing an inner glass pane, an outer panel framing an outer glass pane that is spaced apart from the inner glass pane;

a pivot arrangement that pivotably mounts the door assembly to the housing for permitting movement of the door assembly about a vertical pivot axis between a closed position and an open position relative to the cooking cavity, the pivot arrangement including at least one pivot part located on the door assembly and at least one pivot part located on the housing;

wherein the pivot part of the door assembly is separable from the pivot part of the housing via vertically upward movement of the door assembly and upon separation of the pivot part of the door assembly from the pivot part of the housing the door becomes completely removed from the housing to enable the door assembly to be taken to a washing station for cleaning;

wherein the door assembly includes a plurality of openings that permit fluid to enter a space between both the inner panel and the outer panel and the inner glass pane and the outer glass pane during cleaning of the door assembly such that the fluid can contact an inner surface of the inner glass pane and an inner surface of the outer glass pane for cleaning;

wherein the door assembly includes an inner skin an outer skin;

the inner skin comprises the inner panel and at least one flange, the flange having multiple openings therein;

the outer skin comprises the outer panel and at least one flange, the flange of the outer skin having multiple openings therein;

wherein the inner skin is assembled with the outer skin such that the flange of the inner skin overlaps with the flange of the outer skin, with the openings of the respective flanges aligned to provide fluid access to the space between both the inner panel and the outer panel and the inner glass pane and the outer glass pane;

wherein the door assembly further includes a frame component extending along top, bottom and side portions of the door assembly, the frame component including a frame segment with a plurality of openings therein that align with the aligned openings of the respective flanges of the inner skin and the outer skin.

2. The cooking oven of claim 1 wherein the inner skin, outer skin and frame component are secured together by multiple fasteners.

3. The cooking oven of claim 1 wherein the pivot part of the door assembly is a female member and the pivot part of the housing is a male member.

4. A cooking oven, comprising:

a housing defining an internal cooking cavity with an opening for enabling food items to be moved into and out of the cooking cavity;

a door assembly including an inner skin with a first opening covered by an inner glass pane, an outer skin with a second opening covered by an outer glass pane, the inner skin and the outer skin connected together to hold the inner glass pane and outer glass pane in an aligned but spaced apart relationship;

a pivot arrangement that pivotably mounts the door assembly to the housing for permitting movement of the door assembly about a vertical pivot axis between a closed position and an open position relative to the cooking cavity, the pivot arrangement including at least one pivot part fixed to the door assembly and at least one pivot part fixed to the housing;

wherein the pivot part of the door assembly is separable from the pivot part of the housing via vertically upward movement of the door assembly and upon separation of the pivot part of the door assembly from the pivot part of the housing the door becomes removed from the housing to enable the door assembly to be taken to a washing station for cleaning;

wherein the door assembly includes a plurality of openings that permit fluid to enter a space between both the inner skin and outer skin and the inner glass pane and the outer glass pane during cleaning of the door assembly such that the fluid can contact an inner surface of the inner glass pane and an inner surface of the outer glass pane for cleaning;

wherein the inner skin comprises an inner panel and at least an upper flange and a lower flange, the inner panel framing the first opening, each of the upper flange and the lower flange including multiple openings therein;

wherein the outer skin comprises an outer panel and at least an upper flange and a lower flange,the outer panel framing, the second opening, each of the upper flange and the lower flange including multiple openings therein;

wherein the inner skin is assembled with the outer skin such that the upper flange of the inner skin overlaps with the upper flange of the outer skin with the openings of each upper flange aligned, and the lower flange of the inner skin overlaps with the lower flange of the outer skin with the openings of each lower flange aligned.

5. The cooking oven of claim 4 wherein:

the door assembly further includes a frame component extending along top, bottom and side portions of the door assembly, the frame component including an upper frame segment with a plurality of openings therein that align with the aligned openings of the upper flanges, the frame component including a lower frame segment with a plurality of openings therein that align with the aligned openings of the lower flanges.

6. The cooking oven of claim 5 wherein the inner skin, outer skin and frame component are secured together by multiple fasteners.

7. The cooking oven of claim 5 wherein:

the inner skin includes first and second side flanges;

the outer skin includes first and second side flanges;

the frame component includes first and second side frame segments;

the first side flange of the inner skin, first side flange of the outer skin and first side frame segment are positioned in a stacked manner;

the second side flange of the inner skin, second side flange of the outer skin and second side frame segment are positioned in a stacked manner.

8. The cooking oven of claim 4 wherein:

the inner skin includes first and second side flanges;

the outer skin includes first and second side flanges;

the door assembly further includes a frame component extending about top, bottom and side portions of the door assembly, the frame component including an upper frame segment, a lower frame segment a first side frame segment and a second side frame segment, the upper, lower, first side and second side frame segments of the frame component are located respectively inward of and adjacent to the upper, lower, first side and second side flanges of the inner skin;

the upper, lower, first side and second side flanges of the inner skin are located respectively inward of and adjacent to the upper, lower, first side and second side flanges of the outer skin.

9. The cooking oven of claim 8 wherein the upper fame segment includes a plurality of openings therein that align with the aligned openings of the upper flanges, the lower fame segment includes a plurality of openings therein that align with the aligned openings of the lower flanges.

10. The cooking oven of claim 9 wherein the inner skin, outer skin and frame component are secured together by multiple fasteners.

11. The cooking oven claim 4 wherein the pivot part of the door assembly is a female member and the pivot part of the housing is a male member.

12. A method of using the oven of claim 1, comprising:

removing the door assembly from the housing;

transporting the door assembly to a washing station;

spraying and/or submerging the door assembly with cleaning fluid at the washing station, including passing cleaning fluid into the internal space of the door assembly;

rinsing the door assembly, including passing rinsing fluid into the internal space of the door assembly;

transporting the door assembly back to a location of the housing; and remounting the door assembly onto the housing.

13. A cooking oven, comprising:

a housing defining an internal cooking cavity with an opening for enabling food items to be moved into and out of the cooking cavity;

a door assembly including an inner panel framing an inner glass pane, an outer panel framing an outer glass pane that is spaced apart from the inner glass pane;

a pivot arrangement that pivotably mounts the door assembly to the housing for permitting movement of the door assembly about a vertical pivot axis between a closed position and an open position relative to the cooking cavity, the pivot arrangement including at least one pivot part located on the door assembly and at least one pivot part located on the housing;

wherein the pivot part of the door assembly is separable from the pivot part of the housing via vertically upward movement of the door assembly and upon separation of the pivot part of the door assembly from the pivot part of the housing the door becomes completely removed from the housing to enable the door assembly to be taken to a washing station for cleaning;

wherein the door assembly includes a plurality of openings that permit fluid to enter a space between both the inner panel and the outer panel and the inner glass pane and the outer glass pane;

wherein the door assembly includes an inner skin an outer skin, the inner skin comprises the inner panel and at least a first flange, the first flange having multiple openings therein, the outer skin comprises the outer panel and at least a second flange, the second flange of the outer skin having multiple openings therein;

wherein the inner skin is assembled with the outer skin such that the first flange and the second flange overlap, with the openings of the first flange aligned with the openings of the second flange to provide fluid access to the space between both the inner panel and the outer panel and between the inner glass pane and the outer glass pane;

wherein the door assembly further includes a frame component including a frame segment with a plurality of openings therein that align with the aligned openings of the first flange and the second flange.

* * * * *